US009441916B2

(12) United States Patent
Seuk

(10) Patent No.: US 9,441,916 B2
(45) Date of Patent: Sep. 13, 2016

(54) BODY ARMOR PLATE AND PLATE CARRIER SYSTEM

(71) Applicant: Jo Won Seuk, Highland Falls, NY (US)

(72) Inventor: Jo Won Seuk, Highland Falls, NY (US)

( * ) Notice: Subject to any disclaimer, the term of this patent is extended or adjusted under 35 U.S.C. 154(b) by 66 days.

(21) Appl. No.: 14/481,836

(22) Filed: Sep. 9, 2014

(65) Prior Publication Data

US 2015/0323289 A1 Nov. 12, 2015

Related U.S. Application Data

(60) Provisional application No. 61/875,466, filed on Sep. 9, 2013, provisional application No. 61/980,431, filed on Apr. 16, 2014.

(51) Int. Cl.
*F41H 5/08* (2006.01)
*F41H 1/02* (2006.01)

(52) U.S. Cl.
CPC ..... *F41H 1/02* (2013.01)

(58) Field of Classification Search
CPC ..... F41H 1/02; F41H 5/0457; F41H 5/0471; F41H 5/0414
USPC ..... 2/2.5; 89/36.05
See application file for complete search history.

(56) References Cited

U.S. PATENT DOCUMENTS

| | | | | | |
|---|---|---|---|---|---|
| 3,783,449 | A * | 1/1974 | Davis | F41H 1/02 | 2/2.5 |
| 4,413,357 | A * | 11/1983 | Sacks | F41H 1/02 | 2/2.5 |
| 8,572,762 | B2 * | 11/2013 | Herbener | F41H 1/02 | 2/2.5 |
| 8,739,312 | B1 * | 6/2014 | Brown | F41H 1/02 | 2/2.5 |
| 2012/0132066 | A1 * | 5/2012 | Seuk | F41H 1/02 | 89/36.05 |
| 2013/0312149 | A1 * | 11/2013 | Asher | F41H 1/02 | 2/2.5 |
| 2015/0153141 | A1 * | 6/2015 | Brown | F41H 1/02 | 2/2.5 |
| 2015/0211829 | A1 * | 7/2015 | Cole | F41H 1/02 | 2/463 |
| 2015/0285594 | A1 * | 10/2015 | Seuk | F41H 1/02 | 2/2.5 |
| 2015/0300784 | A1 * | 10/2015 | Scarinci | F41H 5/013 | 89/36.02 |

* cited by examiner

*Primary Examiner* — Samir Abdosh
(74) *Attorney, Agent, or Firm* — R. Tracy Crump

(57) ABSTRACT

Individual body armor plates have an integral hook and/or loop pile coverings that allow the plates to directly affix to the mating hook and loop material of the plate carrier apparatus. The use of hook and loop fastener materials to directly affix and support the armor plates to the carrier apparatus eliminates the need for enclosed internal pouches or pockets, thereby greatly reducing overall weight and bulk of the armor plate carrier system. Integrating hook and loop fastener materials into the covering of armor plates also allows the armor plates to be suspended for a wearer with only shoulder straps, harnesses and cummerbunds having corresponding hook and look fastener materials.

18 Claims, 19 Drawing Sheets

BODY ARMOR PLATE AND PLATE CARRIER SYSTEM

This application claims the benefit of U.S. Provisional Application No. 61/875,466 filed Sep. 9, 2013 and U.S. Provisional Application No. 61/980,431 filed Apr. 16, 2014, the disclosure of which is hereby incorporated by reference.

This invention relates armor plate carriers for personal body armor, and in particular a body armor plate and carrier system using hook and loop fasteners to secure the plates to the carriers.

BACKGROUND AND SUMMARY OF THE INVENTION

Rigid ballistic armor plates, also known as rifle plates, are cloth covered plates of ballistic material, such as hardened steel, ceramic composites, or thermally formed and bonded layered ballistic fabric. Armor plates are used as inserts in specialized garments, called plate carriers, that suspend and position the plate on the wearer's body. Plate carriers are well known in the military and law enforcement communities. Heretofore, plate carriers have used internal pockets or pouches to support the ballistic plates. The use of pockets and pouches simply to support the weight and bulk of the ballistic plates within the carrier adds significant bulk and weight to the wearer. Due to the equipment loads carried, reducing the weight of the plates and the plate carriers is always beneficial to military and law enforcement personal.

The present invention provides for body armor plates having an integral hook and loop covering that allows the plates to directly affix to a mating garment fabric. Replacing the conventional cloth outer covering of a ballistic plate with an integrated hook and loop fastener material allows the armor plates to be directly attached to any corresponding hook and loop fastener material on the supporting plate carrier apparatus, thereby eliminating the need for enclosed internal pouches or pockets and greatly reduces overall weight and bulk of the armor plate carrier system. Integrating hook and loop fastener materials into the covering of armor plates also allows the armor plates to be suspended for a wearer with only shoulder straps, harnesses and cummerbunds having corresponding hook and look fastener materials.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangement of system and method components. The drawings are only for purposes of illustrating exemplary embodiments and are not to be construed as limiting the invention. The drawings illustrate the present invention, in which.

DESCRIPTION OF THE PREFERRED EMBODIMENT

Figure 1:
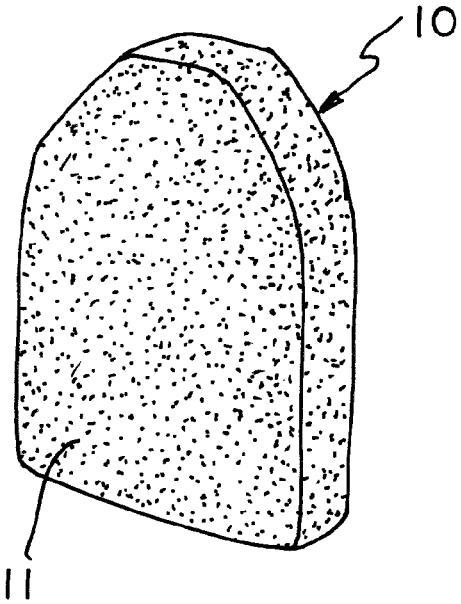
FIG. 1 is a rear perspective view of an embodiment of an armor plate of this invention.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical, structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

The drawings illustrate various embodiments of the armor plates and the plate carrier apparatus, which are incorporated into this invention. Each embodiment of the individual armor plates of this invention have an integral hook and/or loop pile coverings that allow the plates to directly affix to the mating hook and loop material of the plate carrier apparatus. Hook and loop fastener materials, such as that commonly available from Velcro Industries B.V. LLC. under the trademarked brand VELCRO®, are well known to those skilled in the art. The use of hook and loop fastener materials to directly affix and support the armor plates to the carrier apparatus eliminates the need for enclosed internal pouches or pockets, thereby greatly reducing overall weight and bulk of the armor plate carrier system. Integrating hook and loop fastener materials into the covering of armor plates also allows the armor plates to be suspended for a wearer with only shoulder straps, harnesses and cummerbunds having corresponding hook and look fastener materials.

The various components and parts of the plate carrier apparatus may be constructed of any suitable material such as a durable, light-weight fabrics, such as Cordura® nylon and in certain embodiments, spunbonded olefin fabric, such as TYVEK (TYVEK® is a trademark of the E. I. du Pont de Nemours and Company). The materials from which the plate carrier apparatus are fashioned are generally selected to resist tears, abrasions and scuffs. The weight of the fabric for the pouch body is selected to provide sufficient rigidity to support the ballistic armor plates and inserts but also any external equipment that may be affixed to the plate carrier. Carrier apparatus may also include various nylon webbing and elastic straps. Quick connect buckles, slides, keepers, locks and other similar fasteners may be employed to connect and secure straps and webbing as desired for any particular application. The materials and manner of construction of the plate carrier apparatus are readily known in the art and will not be described in detail herein. However, each embodiment of the plate carrier apparatus has components that include or are fashioned from sections of hook and loop fastener material, which are used to securely support the armor plates, as well as detachably or adjustably interconnect other carrier components and parts.

Figure 2:
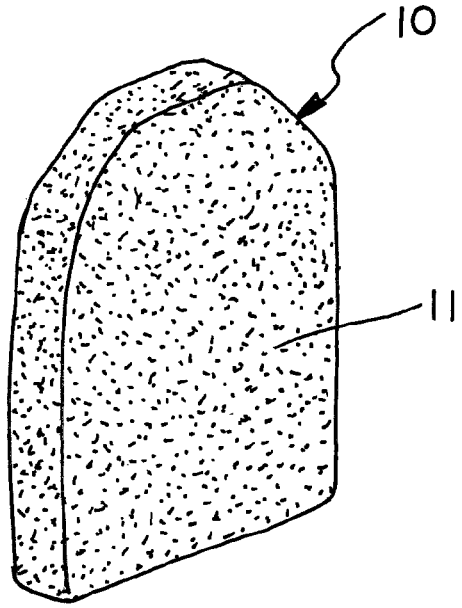
FIG. 2 is a front perspective view of the armor plate of FIG. 1.
Figure 3:
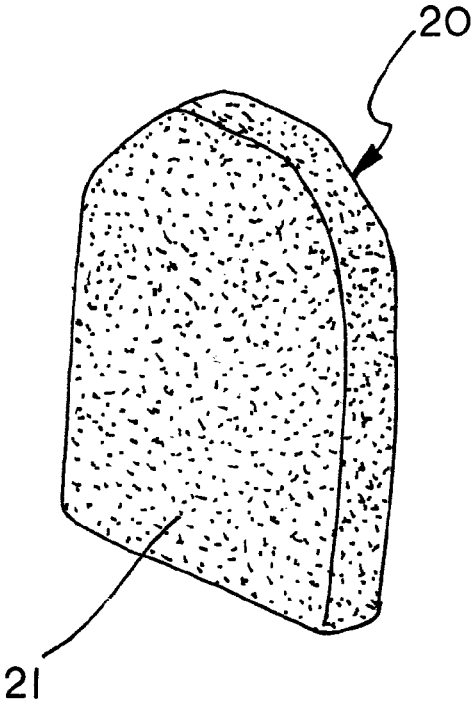
FIG. 3 is a rear perspective view of another embodiment of an armor plate of this invention.
Figure 4:
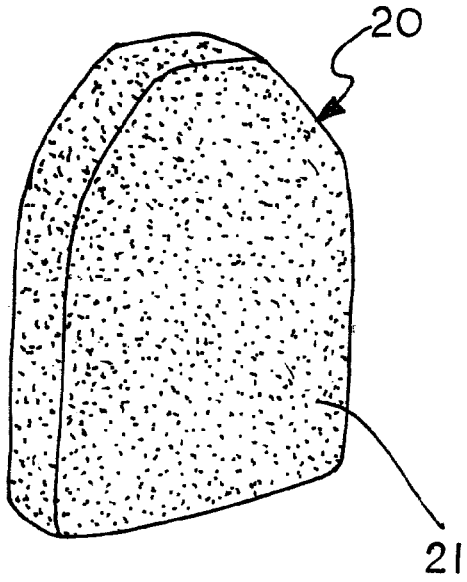
FIG. 4 is a front perspective view of the armor plate of FIG. 3.
Figure 5:
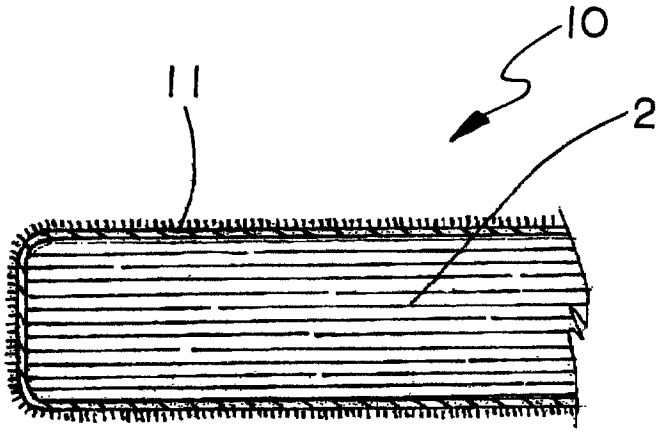
FIG. 5 is a partial sectional view of the armor plate of FIG. 1.

FIGS. 1-5 show two different embodiments of the armor plates of this invention designated as reference numerals, 10 and 20 respectively. Armor plate 10 having an integrated outer covering of loop pile fabric material 11 (FIGS. 1, 2 and 5). Armor plate 20 having an integrated outer covering of hook fastener fabric material 21 (FIGS. 3 and 4). For both armor plates 10 and 20, layers of ballistic material 2, such as Dupont's Kevlar® are bound together and integrally wrapped in an outer covering of either loop fastener pile material 11 or hook fastener pile material 21. Ideally, the outer covering of hook or loop fastener pile material is permanently bound around ballistic layers 2 by a suitable adhesive.

Figure 7:
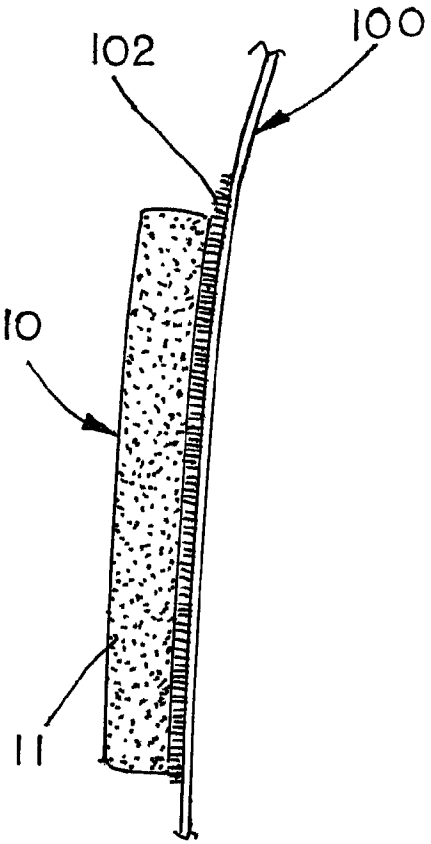
FIG. 7 is a partial side view of the armor plate of FIG. 1 affixed to the plate carrier garment of FIG. 5.
Figure 6:
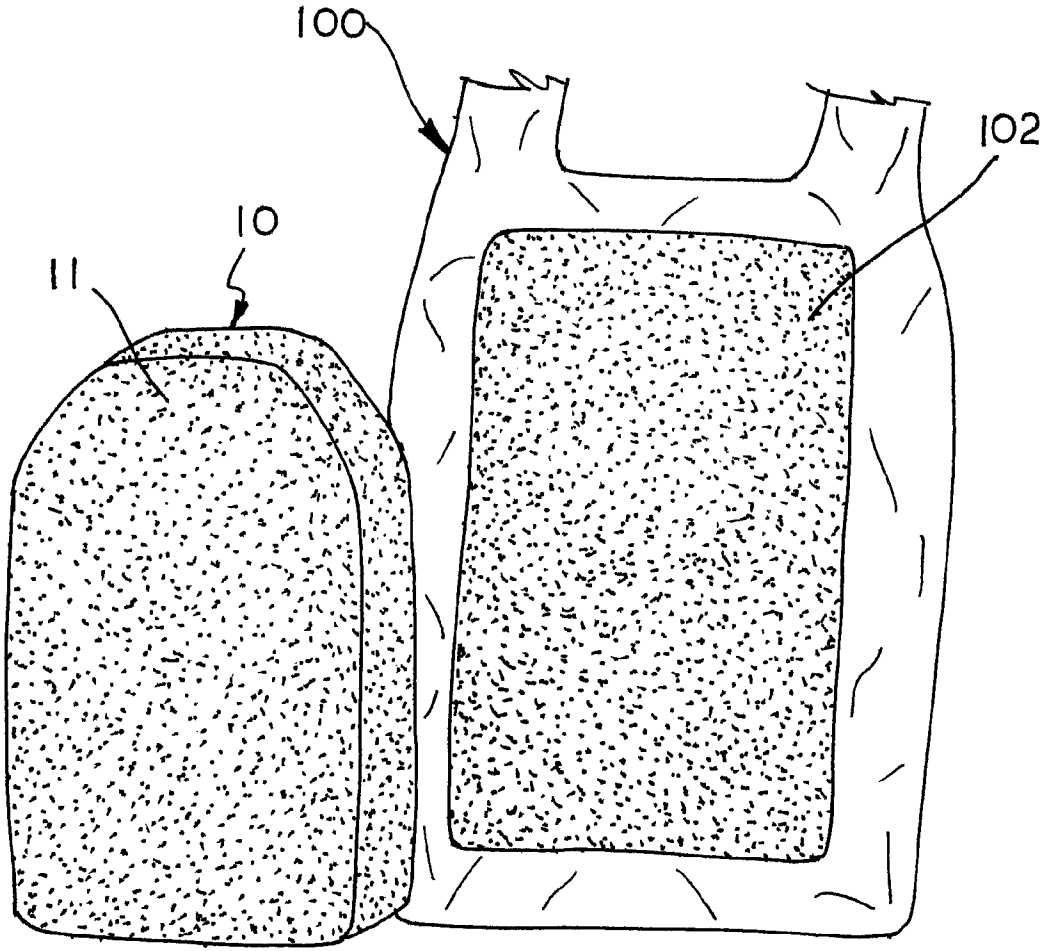
FIG. 6 is a partial exploded view of an embodiment of a plate carrier garment of this invention and the armor plate of FIG. 1.
Figure 8:
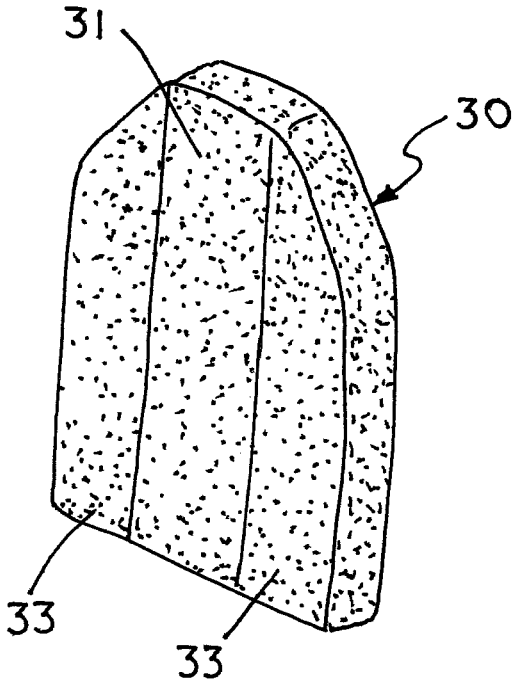
FIG. 8 is a rear perspective view of a third embodiment of an armor plate of this invention.
Figure 9:
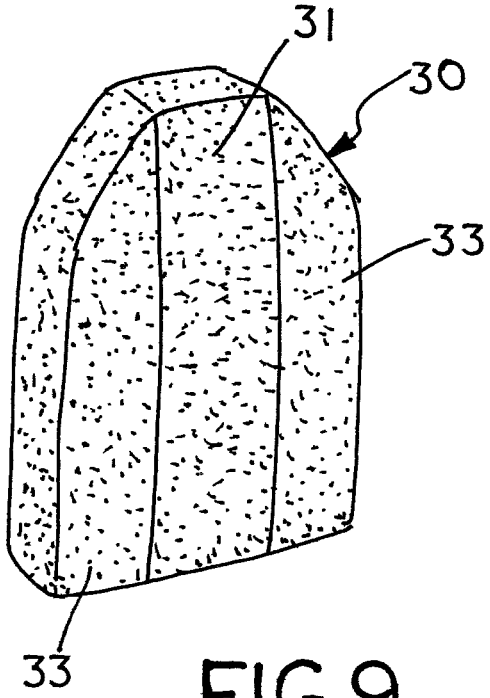
FIG. 9 is a front perspective view of the armor plate of FIG. 7.

FIGS. 6 and 7 illustrate armor plate 10 used with an exemplary support garment 100. Garment 100 includes an outward facing section of hook fastener material 102 affixed to the front of the garment. As shown, armor plate 10 is manually pressed against the front of garment 10 so that the mating loop fastener pile covering 11 of armor plate 10 and the hook fastener pile material 102 mate and interlock securing the armor plate to the garment. FIGS. 8 and 9 show another embodiment of the armor plate of this invention designated generally as reference numeral 30. Armor plate 30 has an integrated outer covering of both hook and loop fabric material. As shown, a center section 31 of both sides of the plate is integrally covered with either the hook fastener fabric or the loop pile fabric and side sections 33 are covered with the other hook fastener fabric or loop pile fabric.

Figure 10:
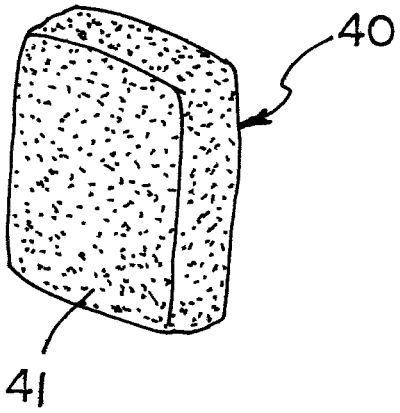
FIG. 10 is a perspective view of an embodiment of a side armor plate of this invention.
Figure 11:
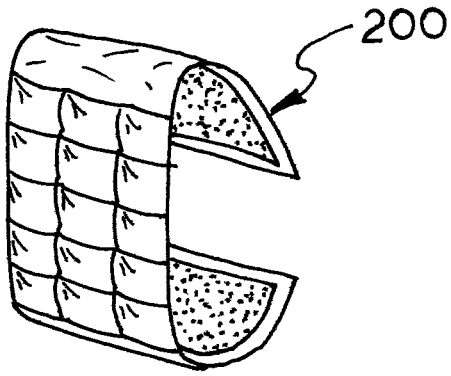
FIG. 11 is a perspective view of a side armor plate support strap of this invention.

FIGS. 10 and 11 show a smaller armor side plate 40 having integral hook and/or loop coverings 231 and a side plate support strap 200.

Figure 13:
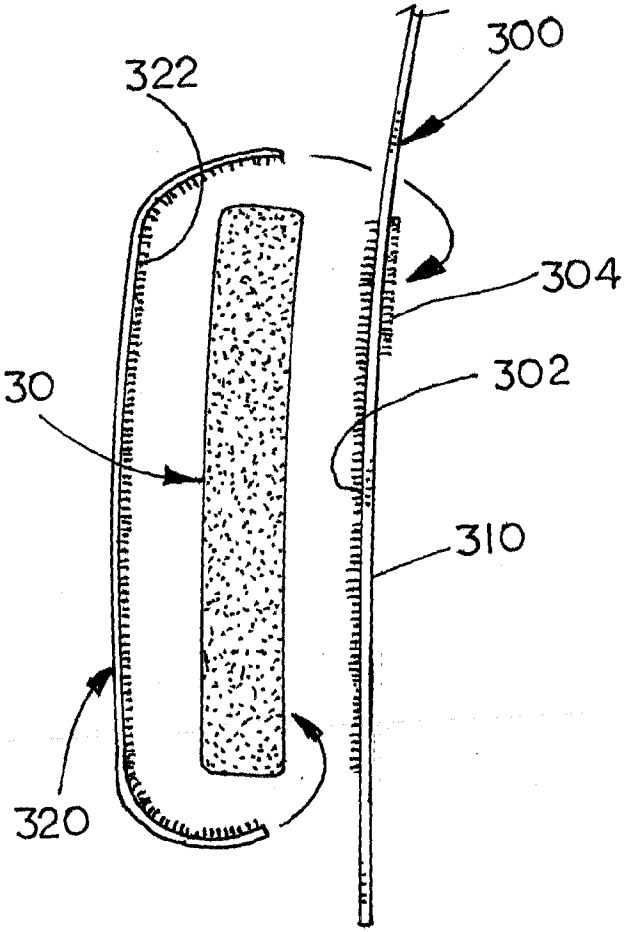
FIG. 13 is a partial side view of the armor plate of FIG. 12 affixed to the plate carrier of FIG. 8.
Figure 12:
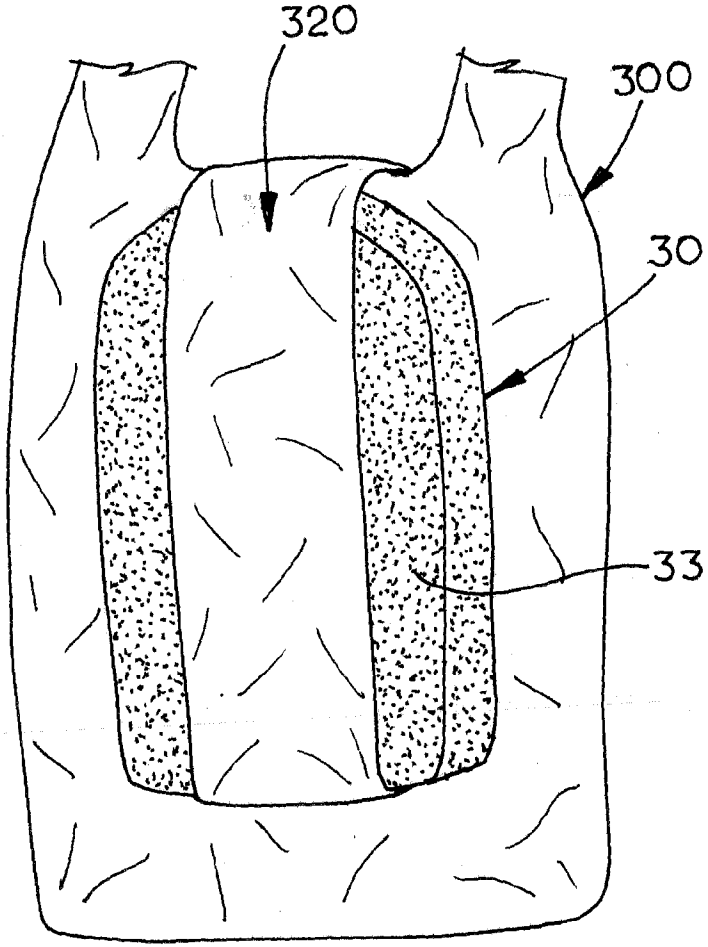
FIG. 12 is a partial perspective view of another embodiment of a plate carrier garment of this invention and the armor plate of FIG. 8.

FIGS. 12-13 illustrate armor plate 30 used with another embodiment of an exemplary support garment 300. Garment 300 has a large outward facing section or patch of mating hook and loop fastener material 302 affixed to its front, so that armor plate 30 can be mounted to the front panel 310 (FIG. 13). Garment 300 also includes a small section of hook and loop fastener material 304 on the inner surface of its front. Armor plate 30 is directly affixed to front of garment 300 and held together by the interface of interlocking covering 31 and the mating hook and loop fabric materials 302. As shown, support strap 320 overlaps armor plate 30 and is secured to garment 300. Support strap 320 is a long rectangular panel having longitudinal sections or patches of hook and loop fabric material 322. As shown, support strap 320 overlies armor plate 30 so that hook and loop fastener material 322 interlocks with the hook and loop coverings 31 of armor plate 30 and the sections of hook and look fastener material 302 and 304 of garment 300 to further secure the armor plate to the front of the garment.

Figure 14:
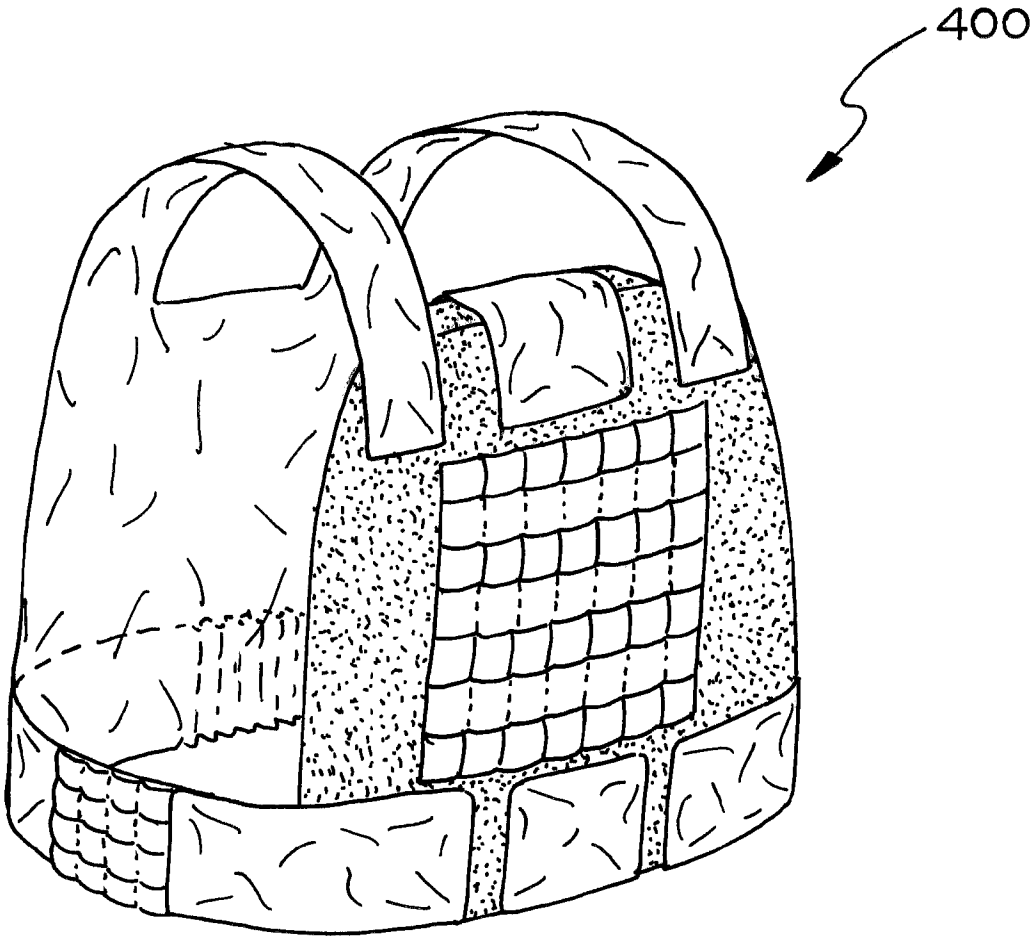
FIG. 14 is a perspective view of an embodiment of a plate carrier system of this invention using the armor plate of FIG. 1, the side armor plate of FIG. 10 and the support strap of FIG. 11.
Figure 15:
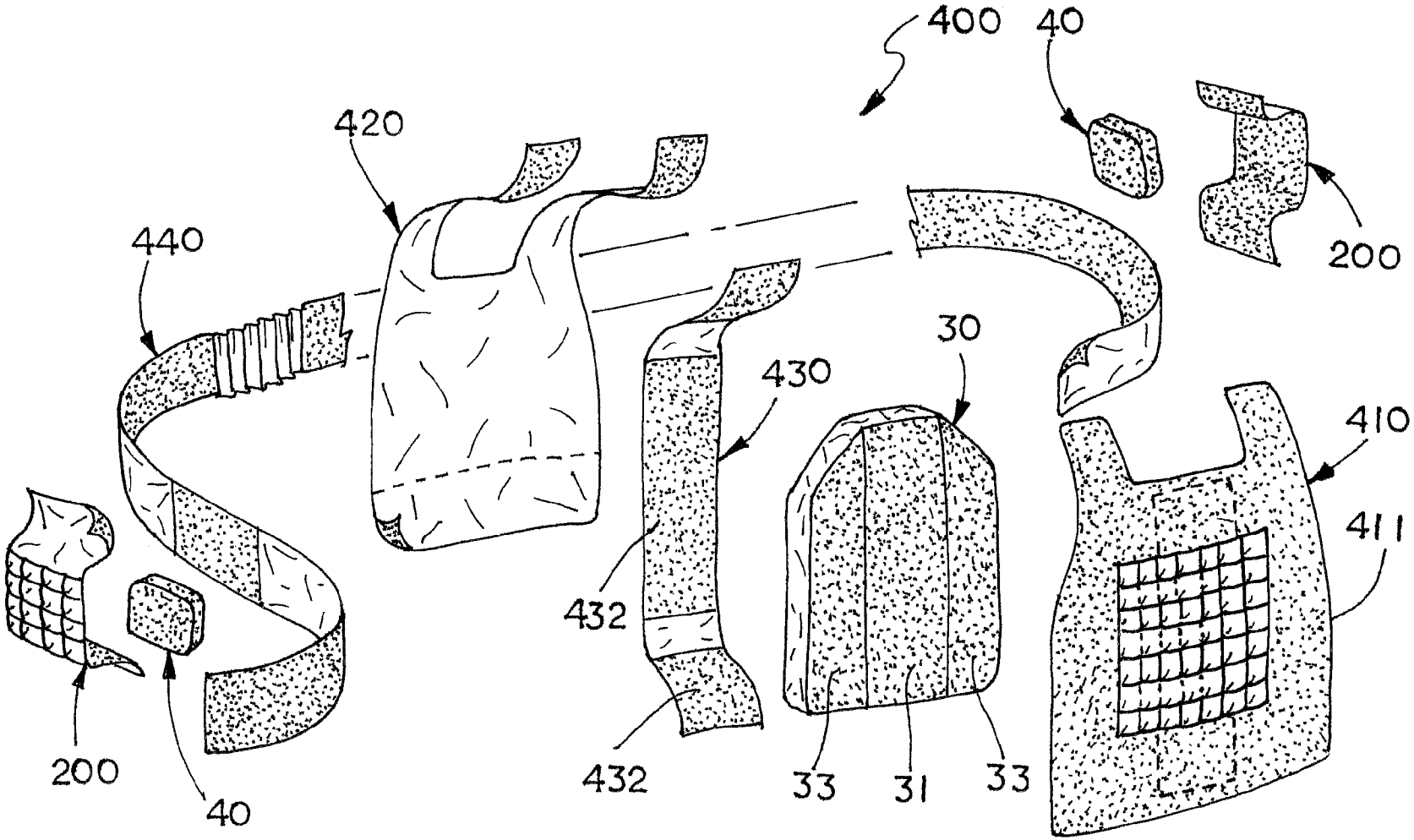
FIG. 15 is an exploded view of the plate carrier system of FIG. 14.
Figure 16:
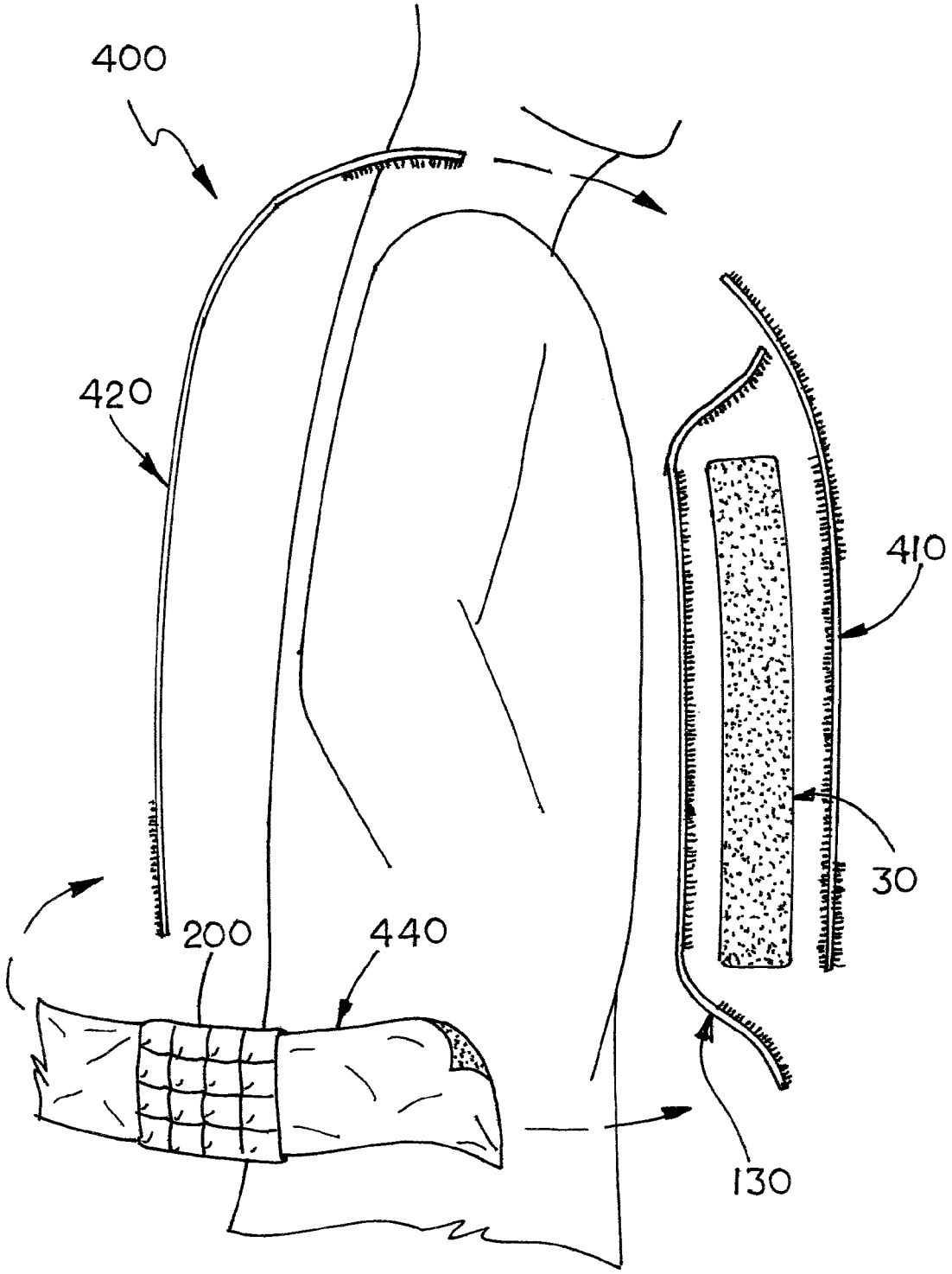
FIG. 16 is a partial exploded side view of the plate carrier system of FIG. 14.
Figure 17:
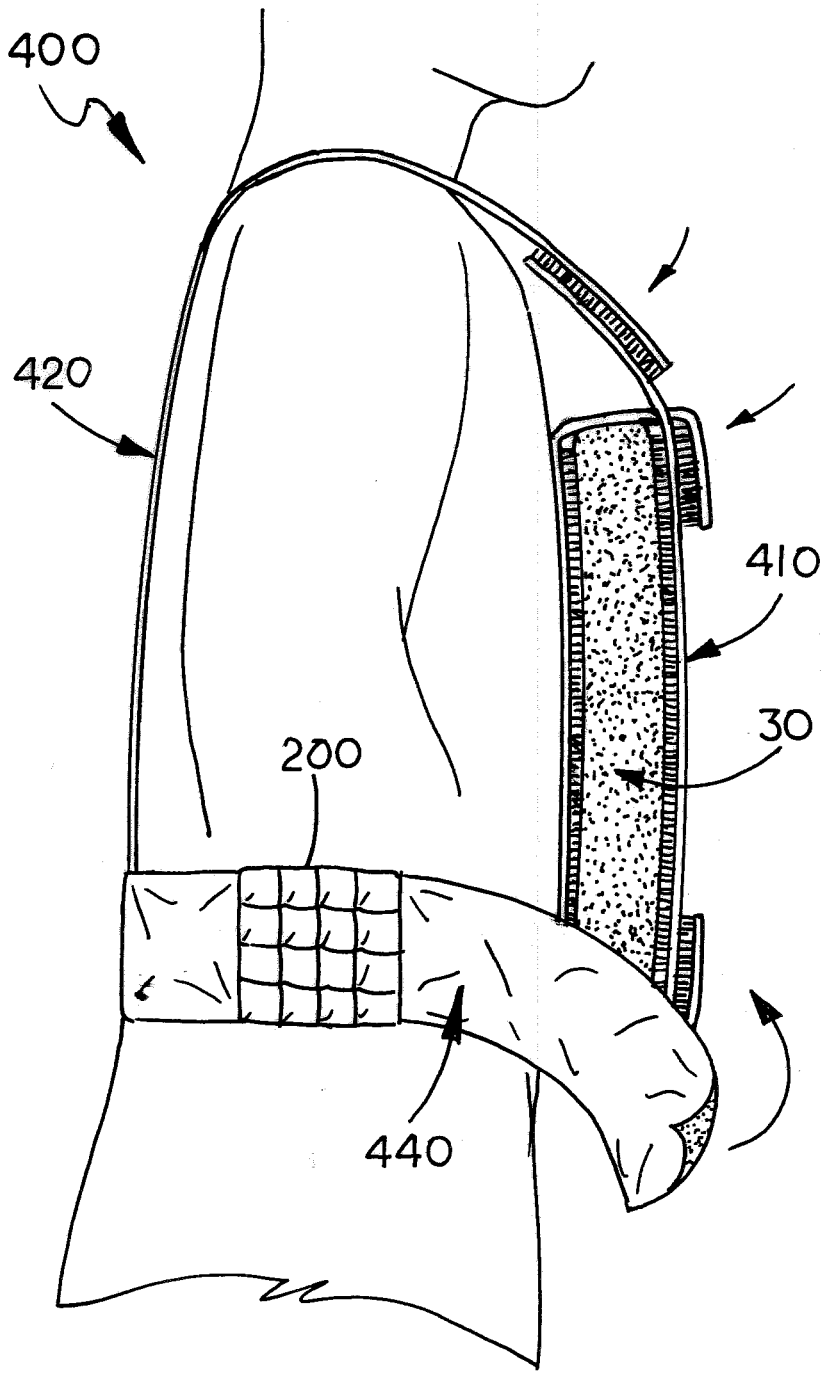
FIG. 17 is a side view of the plate carrier system of FIG. 14.

FIGS. 14 and 17 show an embodiment of a plate carrier 400 used with armor plates 30 and side plate 40. As shown, plate carrier 400 includes a front panel 410, a rear panel 420, plate support strap 430, and a cummerbund 440. Front and rear panels each have corresponding shoulder straps that are adjustably interconnected by overlapping sections or patches of hook and loop fastener materials. Cummerbund 440 is a long strap that encircles the wearer's torso and connects the front panel 410 to rear panel 420. Cummerbund 440 has multiple sections or patches of hook and/or loop fastener material that overlap to connect to front panel 410 and rear panel 420. Cummerbund 440 has elastic sections that allow it to be pulled tightly around the wearer.

The inner and outer surface of front panel 410 have a corresponding hook and/or loop fabric covering ("hook/loop covering") 411 so that armor plate 30 can be mounted to the inside or outside of front panel 410. As shown, armor plate 30 is directly affixed to the inner surface of front panel 410 and held together by the engagement of the aligned and mated hook and loop fastener covering 31 and 411. As shown, support strap 430 overlaps armor plate 30 and is secured to the inner surface of front panel 410. Support strap 430 is a long rectangular fabric panel having longitudinal sections or patches of hook and/or loop fabric material ("hook/loop section") 432. Hook/loop section 432 engaged with hook and/or loop fastener covering 31 of armor plate 30 and hook/loop covering 411 of front panel 410 to further secure armor plate 30 to front panel 410. Side plates 40 are similarly affixed and secured to cummerbund 440 by side plate support strap 200 and the engagement of overlapping hook and/or loop fastener materials on the side plates, cummerbund and support straps.

Figure 18:
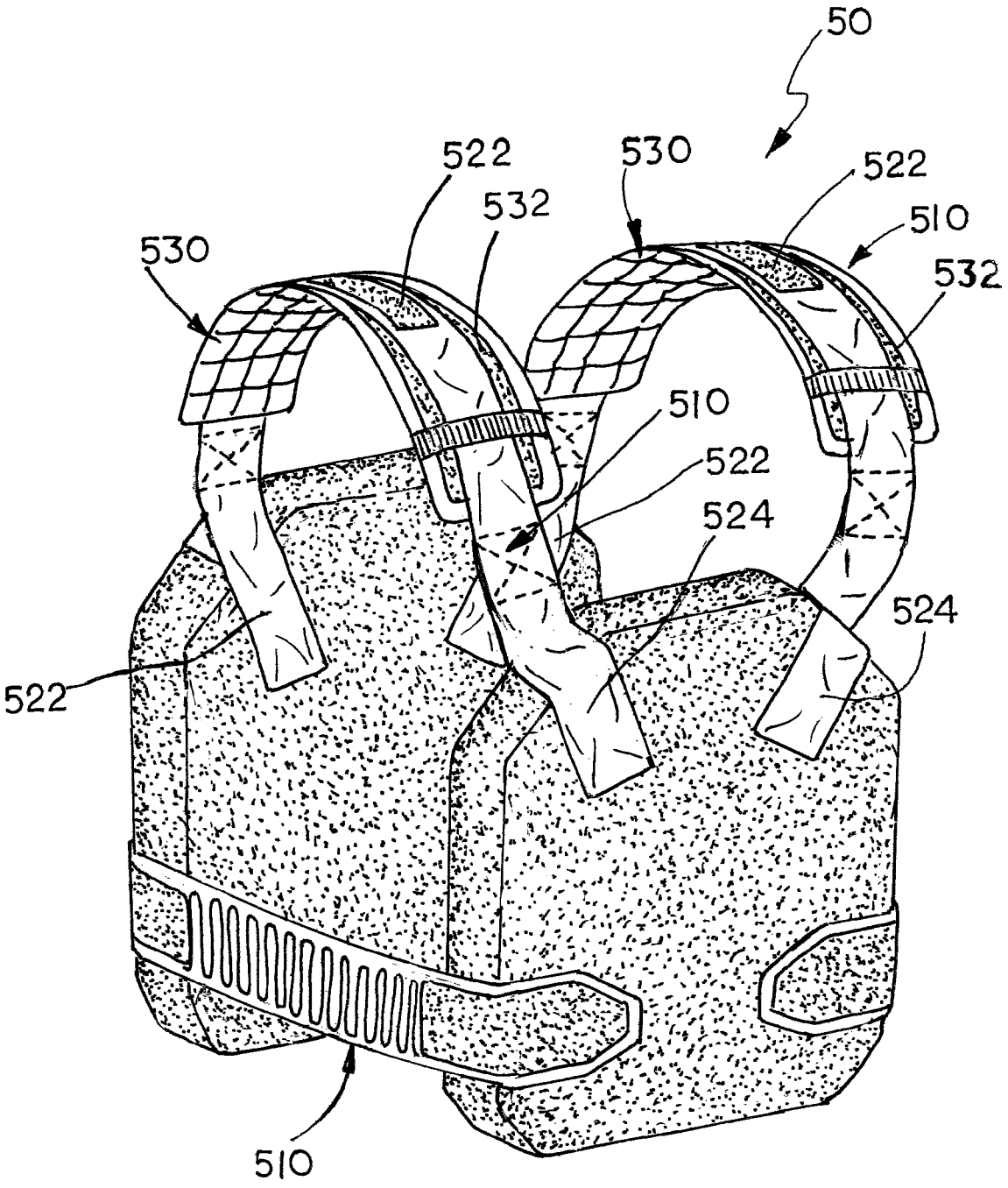
FIG. 18 is a perspective view of a second embodiment of a plate carrier system of this invention.
Figure 19:
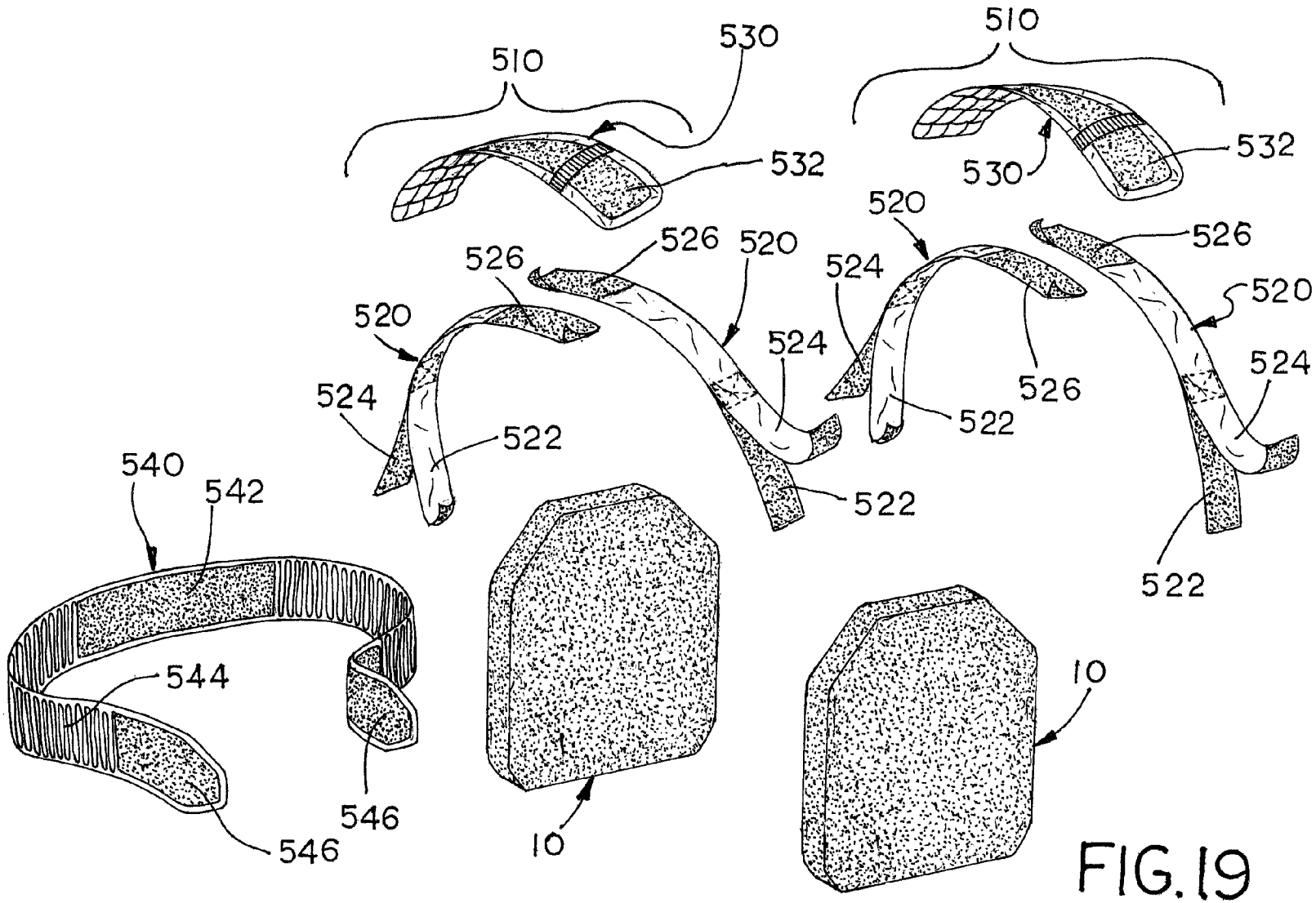
FIG. 19 is an exploded view of the plate carrier system of FIG. 18.
Figure 20:
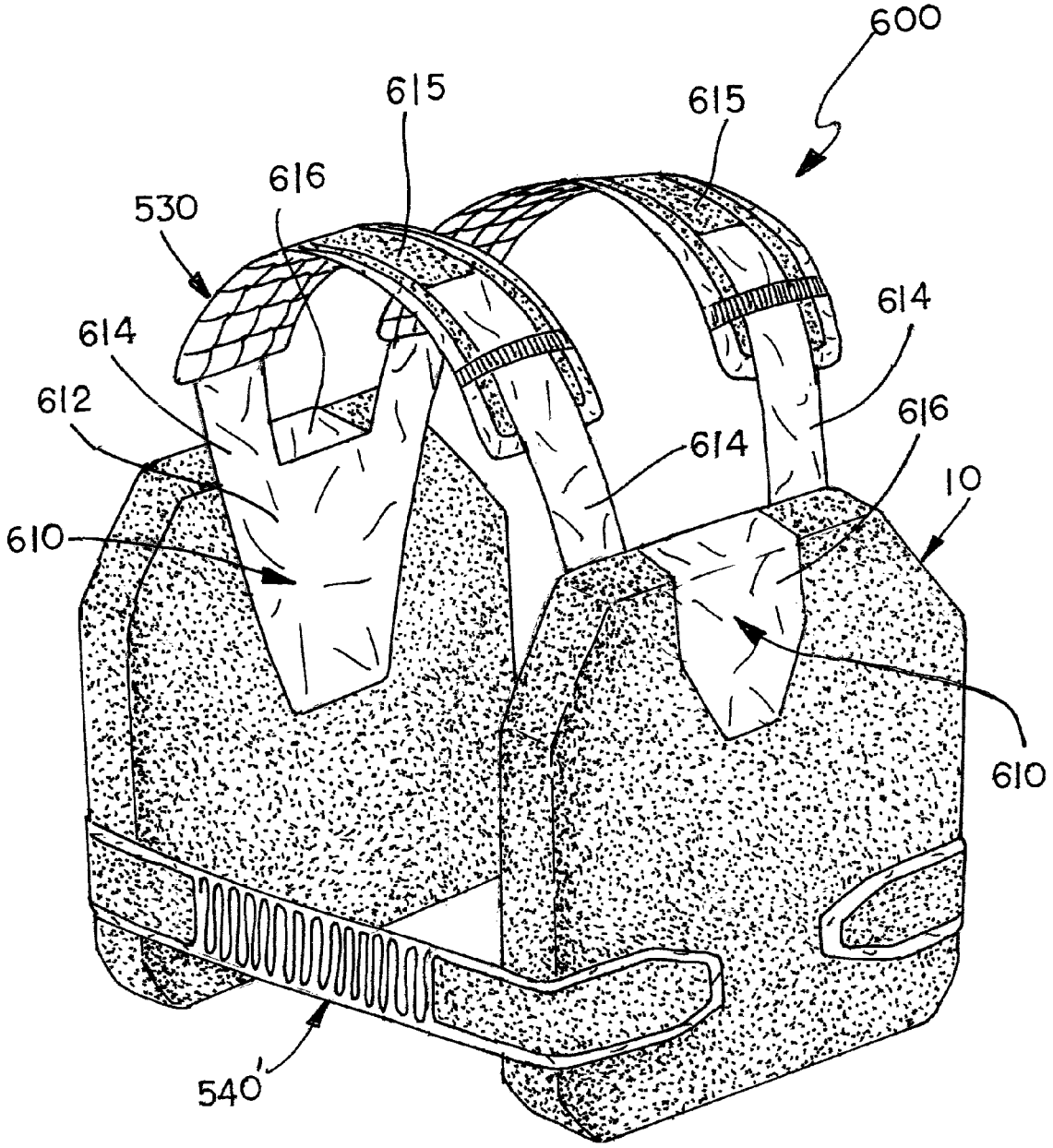
FIG. 20 is a perspective view of a third embodiment of the of a plate carrier system of this invention.
Figure 22:
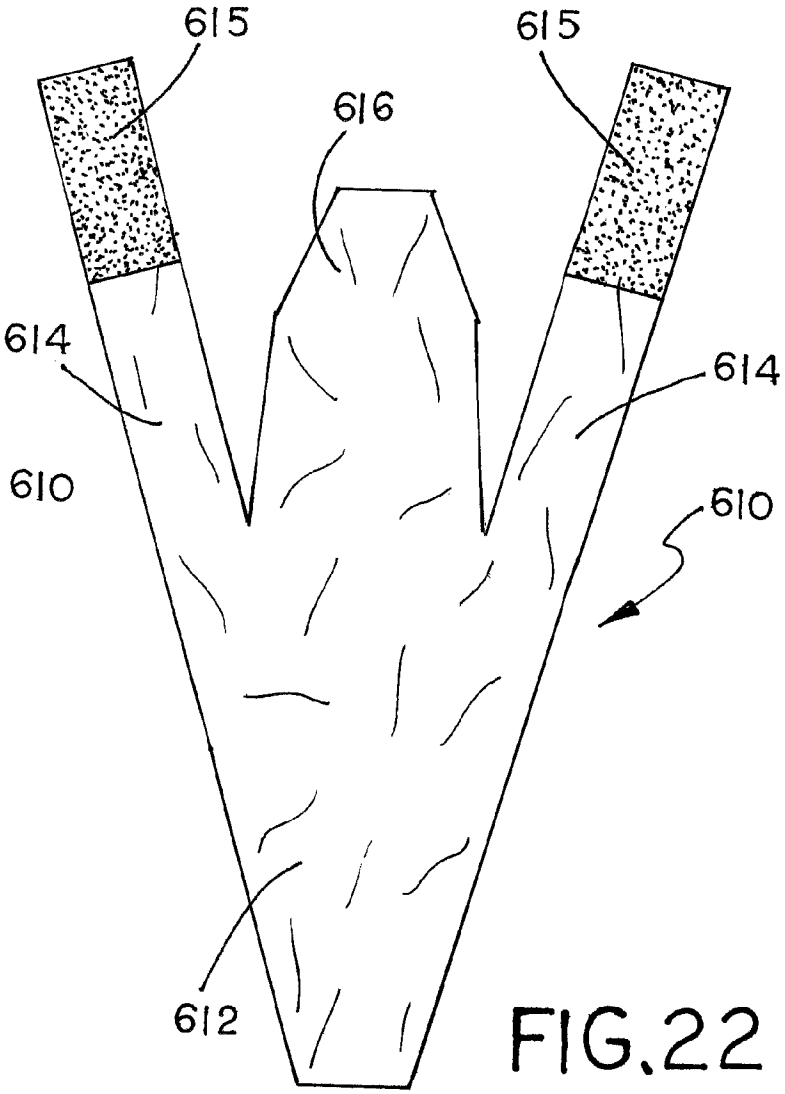
FIG. 22 is a rear view of the plate yoke of the shoulder harness of FIG. 20
Figure 21:
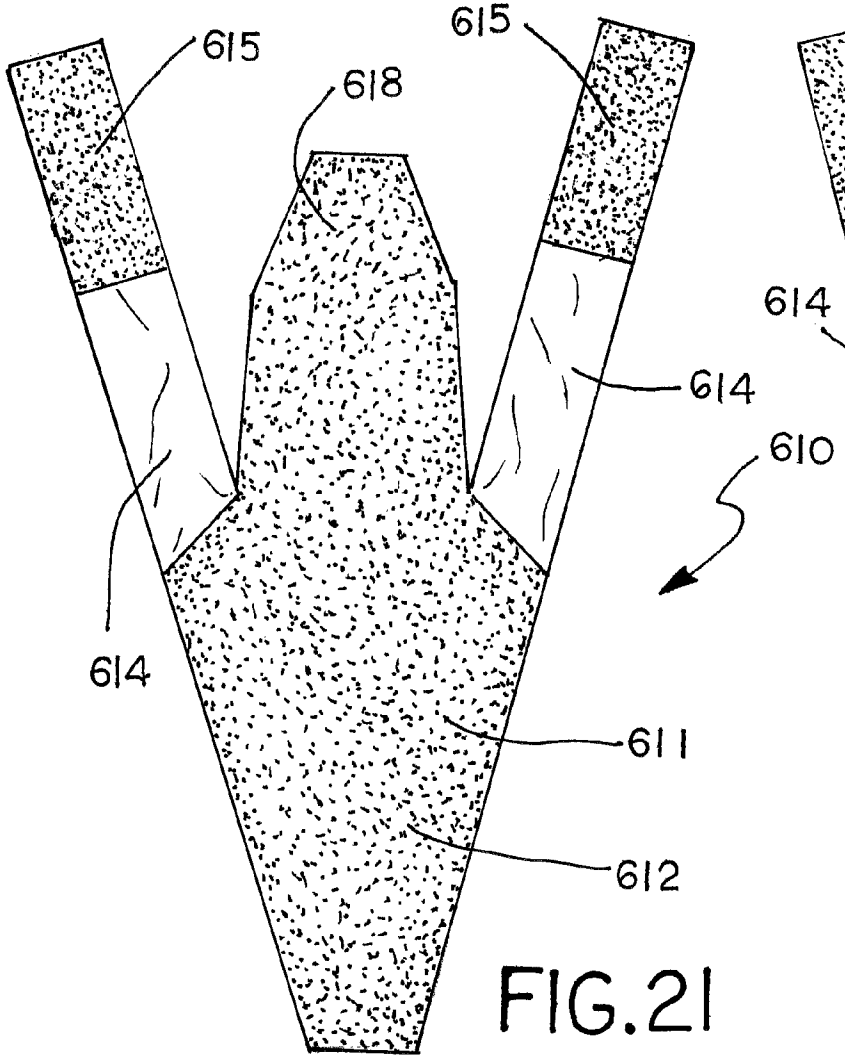
FIG. 21 is a front view of the plate yoke of the shoulder harness of FIG. 20
Figure 23:
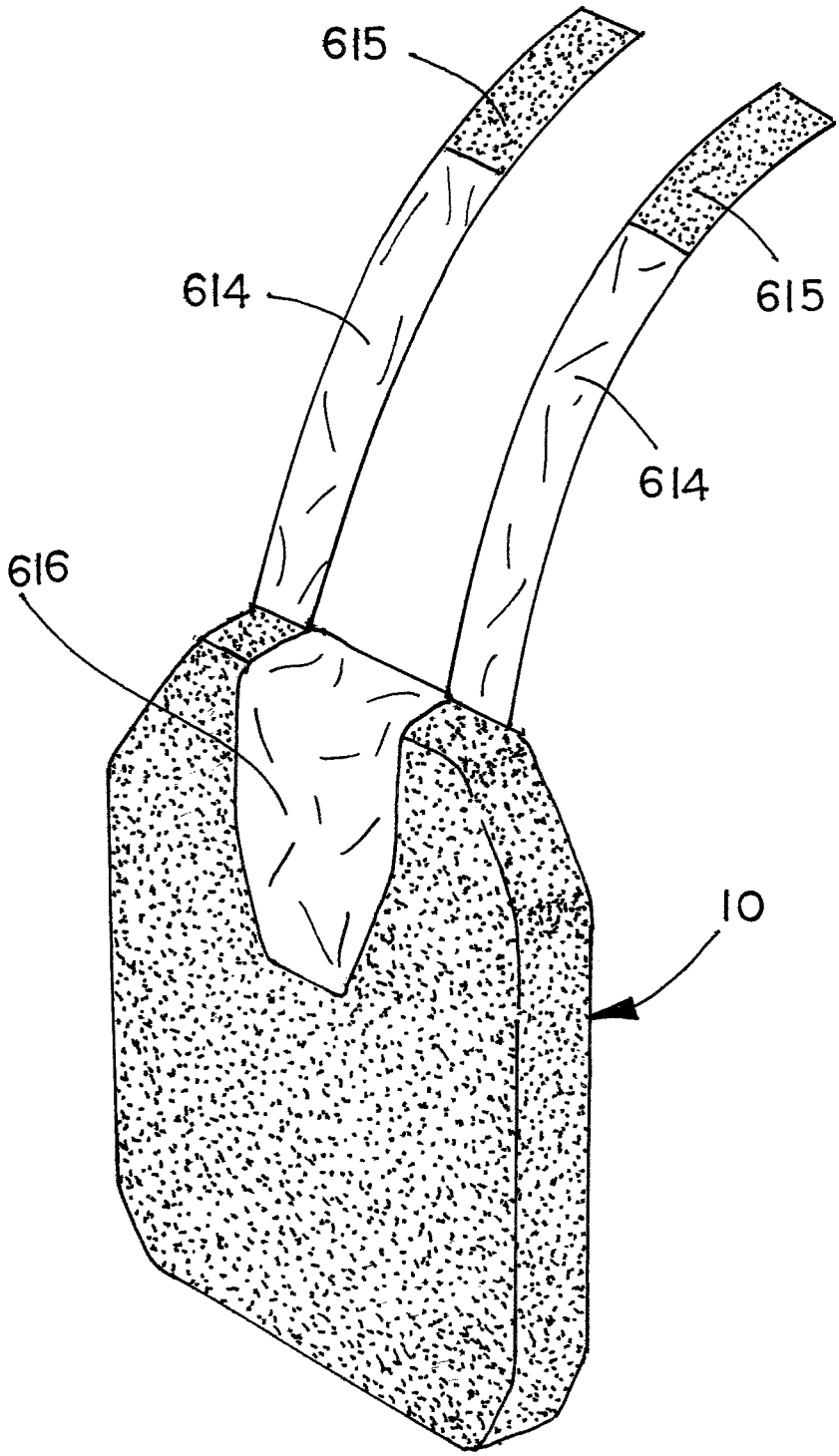
FIG. 23 is a front perspective view of the armor plate of FIG. 1 mounted to the plate yoke of FIG. 20.
Figure 24:
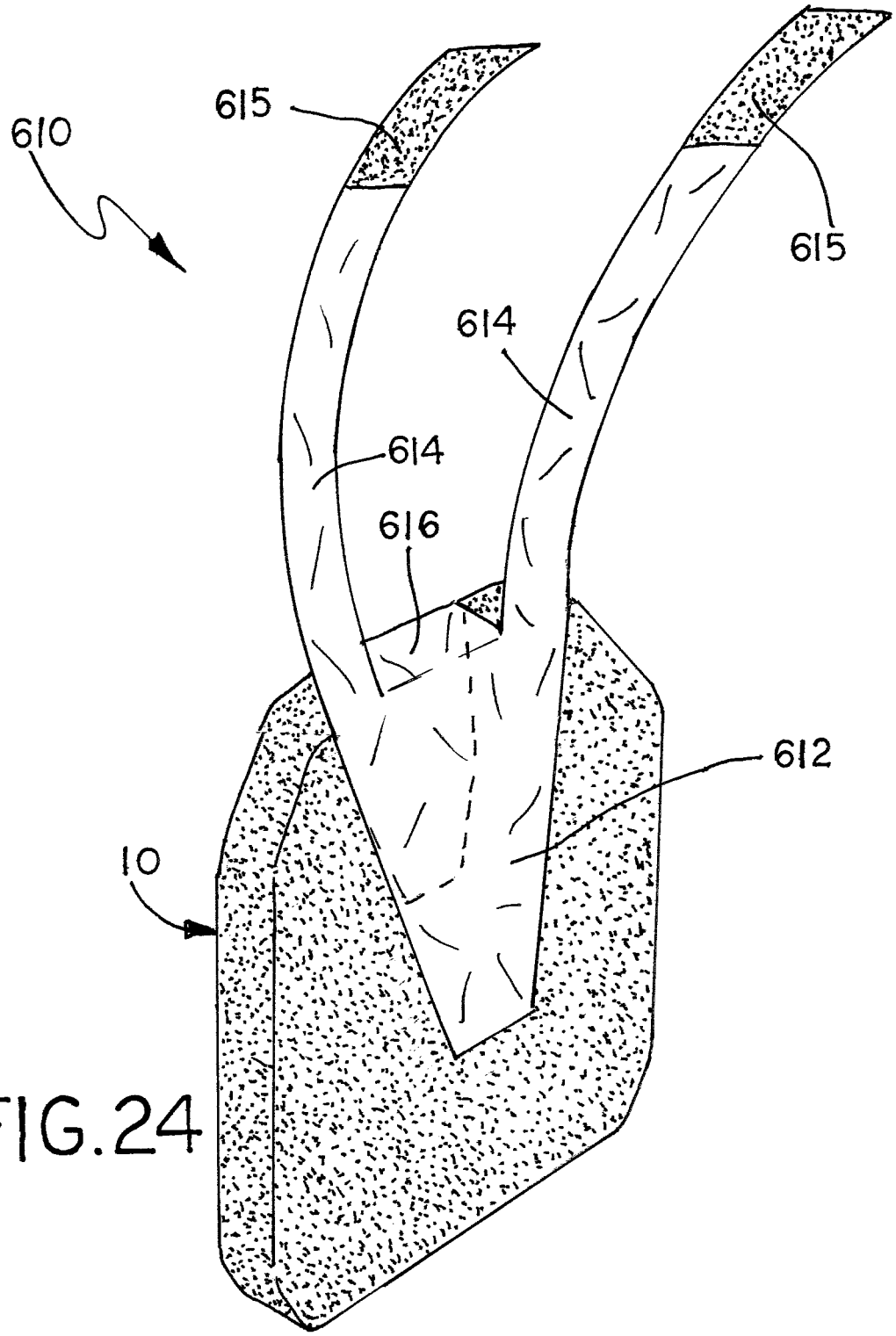
FIG. 24 is a front perspective view of the armor plate of FIG. 1 mounted to the plate yoke of FIG. 20.
Figure 25:
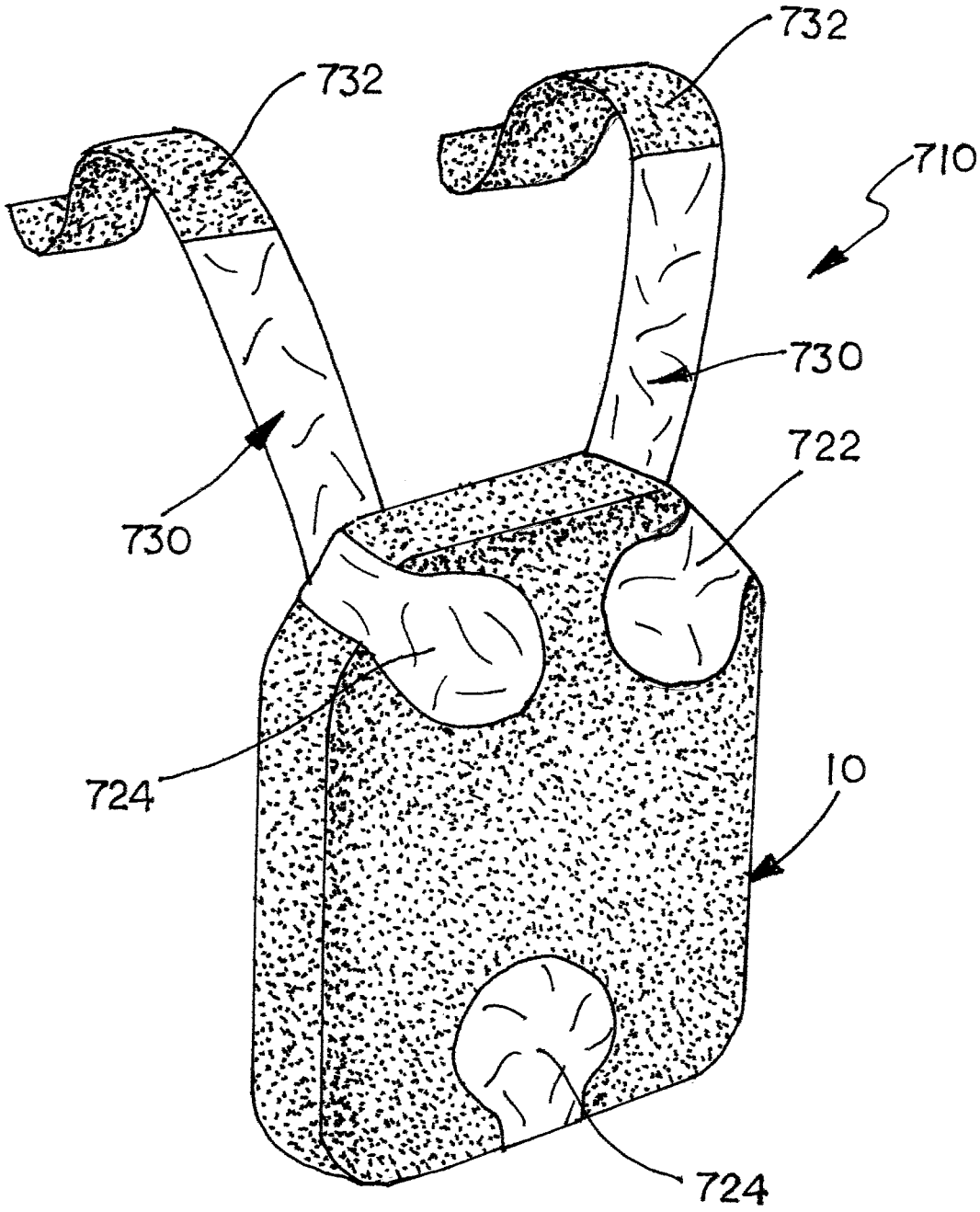
FIG. 25 is a perspective view of the armor plate of FIG. 1 mounted to an alternative embodiment of a plate yoke, which forms part of the plate carrier system of this invention.
Figure 26:
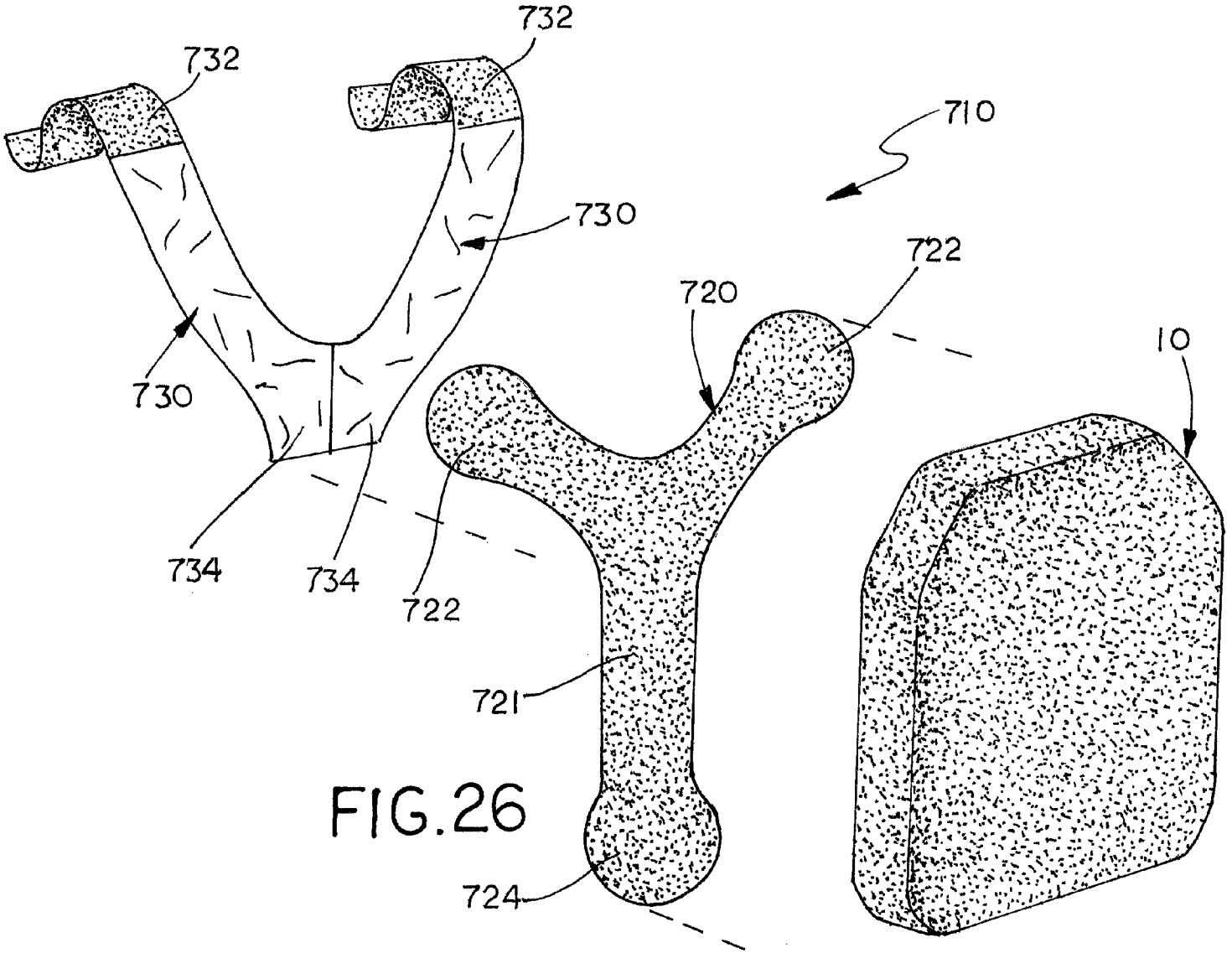
FIG. 26 is an explode view of the armor plate and plate yoke of FIG. 25.
Figure 27:
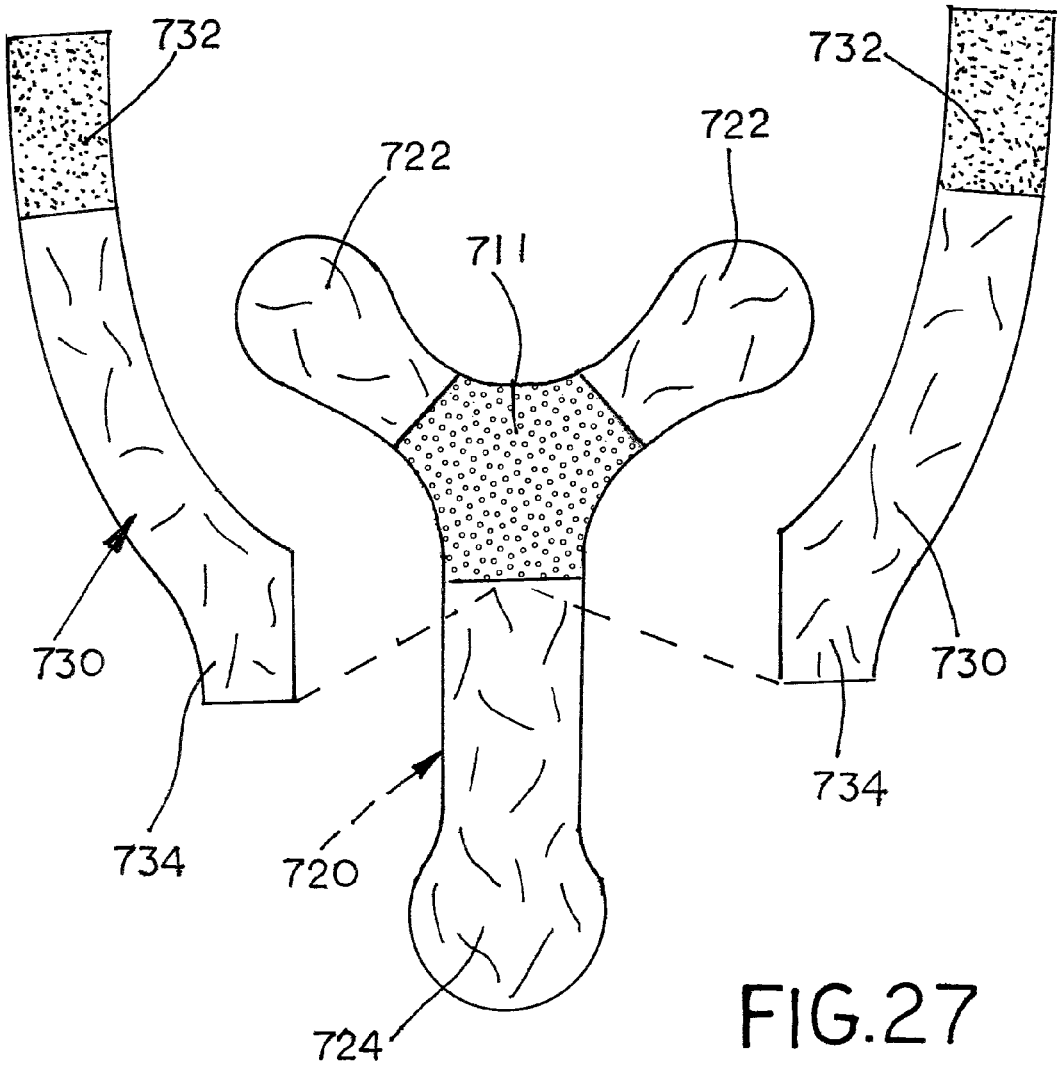
FIG. 27 is a rear view of the plate yoke of FIG. 25.
Figure 28:
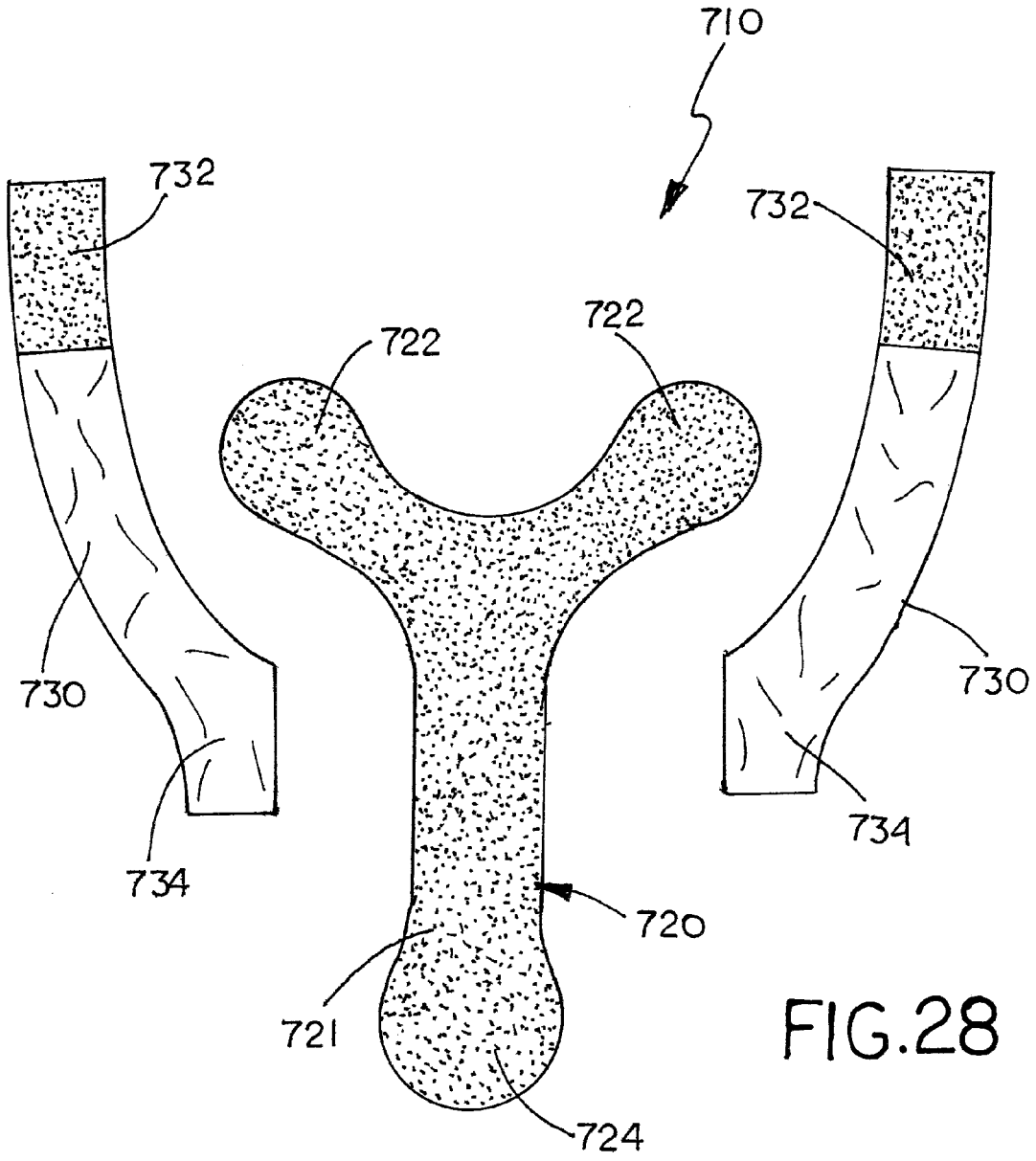
FIG. 28 is a front view of the plate yoke of FIG. 25.

FIGS. 18-19 show various exemplary embodiments of plate carrier systems designed for use with armor plates 10 and 20. These embodiments use separate shoulder strap assemblies and cummerbunds that affix directly to the armor plates using hook and loop fastener materials to provide a very minimalist, low-profile body armor system. The shoulder strap assemblies and cummerbunds are constructed of durable, light weight materials and in certain embodiments may be constructed of spunbonded olefin fabrics, such as TYVEK®. The hook and loop materials that connect the shoulder strap assemblies and cummerbunds may take the form of strips, sections or patches sewn or bonded to the assemblies by adhesives, or in certain embodiments and applications, strips, straps or sections of dual-sided hook and loop fastener materials, such as ONE WRAP® (ONE-WRAP® is a trademark of Velcro Industries B.V. LLC.) that form part of the assemblies themselves. In addition, alternate versions of these embodiments may be modified for use with either armor plates 10 or 20 by changing the mating hook and loop fastener material used on the shoulder strap assemblies and cummerbunds to correspond with the hook and loop fastener covering of the particular armor plate.

FIGS. 18 and 19 show an embodiment of an exemplary plate carrier system designated generally as reference numeral 500 for use specifically with a pair of armor plates 10. Plate carrier system 500 is a three piece design and includes a pair of shoulder straps 510 and a cummerbund 540 that connect directly to the hook and loop coverings 11 of a pair of armor plates 10. Shoulder straps 510 adjustably suspend armor plates 10 over the front and back of the wearer's torso and cummerbund 540 adjustably extend around the armor plates and encircles wearer's torso.

Each of the shoulder straps 510 include identical front and rear strap parts 520 and a padded shoulder strap sleeve 530. Each of the front and rear strap parts 520 have opposed facing strap ends of hook and loop material 522 and 524 that engage the hook and loop covering 11 of armor plate to secure and suspend the armor plate. As shown, armor plate 10 is interposed and secured between strap ends 522 and 524 where strap end 522 overlies the backside of armor plate 10 and strap end 524 wraps around the edges and over the front side of the armor plate. Each of the front and rear strap parts 520 also have a dual sided hook and loop fastener adjustment end 522. Selectively overlapping ends 526 of corresponding front and rear strap parts allows for length adjustments of the shoulder straps 520. Shoulder strap sleeve 530 has an elongated padded body that provides additional comfort for the wearer. Shoulder strap sleeve 530 also has a top strip of hook and loop material ("hook/loop strip") 532 that secures the sleeve to front and rear strap parts 520. As shown, the downward facing side of the overlapping adjustment ends 526 of front and rear strap parts 520 engage hook/loop strip 532 of shoulder strap sleeve 530.

Cummerbund 540 has an elongated body constructed of a dual sided central section of hook and/or loop fastener material 542, a pair of elastic bands 544 and a pair of dual sided ends of hook and/or loop fastener material 546. Central section 542 has hook and loop fastener material on its inward facing surface for engaging the mating hook or loop covering of armor plates 10 and the opposite hook or loop fastener material on its outward facing surface.

FIGS. 20-24 show an alternative shoulder harness 600 which forms part of the plate carrier system of this invention and connect directly to the hook and loop covering 11 of armor plates 10. Shoulder harness 600 provides the same function as shoulder straps 510 of plate carrier system 500 to suspend armor plates 10 over the front and back of the user's torso and is typically used in conjunction with cummerbund 540 and padded shoulder strap sleeves 530 described above or similar plate carrier components. As shown, shoulder harness 600 includes a pair of plate yokes 610 that are interconnected to support armor plate 10 on either the front or back of the wearer.

Plate yokes 610 are ideally constructed entirely from one or more sheets of dual-sided hook and loop materials, such as ONE-WRAP®, but may be constructed from sheets of a light weight durable nylon or spunbonded olefin fabric with sections or patches of hook and loop material affixed to each side thereof. Plate yokes 610 are shaped and configured to have a trapezoidal main panel 612, a pair of elongated strap parts 614 extend from a main panel, and an elongated flap 616 that extends upward from the main panel between the strap parts. One side of plate yokes 610 is covered in hook and loop material and the opposite side is covered in the opposite hook and loop material. Similarly, strap parts 614 terminate in dual sided hook and loop fastener adjustment end 615. As shown, main panel 612 overlies the inward facing surface of armor plate 10 and flap 616 wraps over the edge and outward facing surface of the armor plate. Facing hook and loop material on main panel 612 and flap 616 engages the mating hook and loop covering 11 of armor plate 10 to secure the armor plate to plate yokes 610. As shown, plate yokes 610 are adjustably interconnected with adjustment ends 615 of corresponding strap parts 614 of opposed plate yokes 610 selectively overlapped to allow for length adjustments of the harness.

FIGS. 25-28 show an alternative embodiment of a plate yoke 710 which forms part of a shoulder harness of the plate carrier system of this invention. Shoulder harness 700 is similar in use and function to harness 600 discussed above, connecting directly to the hook and loop covering 11 of armor plates 10. Again, a pair of plate yokes 710 are interconnected to form a shoulder harness that supports a pair of armor plates and in conjunction with cummerbund 540 and padded shoulder strap sleeves 530 described above or similar plate carrier components. Plate yokes 710 includes a pair of elongated shoulder straps 730 affixed to a Y shaped connection member 720. Connection member 720 is cut or otherwise configured in a Y-shape to have a pair of angled arm segments 714 integrally extending from an elongated main segment 712. Both the main segment 712 and arms segments 714 have large circular ends. One side of connection member 710 is covered in hook and loop material 721 for mating engagement with the hook and loop covering 11 of armor plates 10. Shoulder straps 730 terminate at one end in dual sided hook and loop fastener adjustment end 732. The opposite end 734 are joined to connection member 720 at a central point between main segment 712 and arm segments 714 by an adhesive 713. As shown, plate yoke 710 overlie the inward facing surface of armor plate 10 and main segment 722. Arm segments 724 of connection member 720 wrap over the edge and outward facing surface of the armor plate. Facing hook and loop material on connection member 720 engages the mating hook and loop covering 11 of armor plate 10 to secure the armor plate to plate yoke 710.

It should be apparent from the foregoing that an invention having significant advantages has been provided. While the invention is shown in only a few of its forms, it is not just limited but is susceptible to various changes and modifications without departing from the spirit thereof. The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

I claim:

1. A body armor plate comprising:

a flat ballistic plate member having a front surface and a rear surface; and an outer covering of hook and loop fastener material integrally bonded to the ballistic plate member to completely cover the front surface and the rear surface.

2. The armor plate of claim 1 wherein the hook and loop fastener material includes a loop pile.

3. The armor plate of claim 1 wherein the hook and loop fastener material includes a hook pile.

4. A body armor carrier system comprising:

an armor plate having a flat ballistic plate member and an outer covering of hook and loop fastener material integrally bonded to and enveloping the ballistic plate member; and a carrier garment adapted to be donned by a wearer for supporting the armor plate therefrom, the carrier garment having a section of corresponding hook and loop fastener material adapted to detachably receive the outer covering of hook and loop fastener material of the armor plate so that the armor plate is securely affixed to the carrier garment, and an elongate strap adapted to extend over the armor plate and connect to the carrier garment when the armor plate is affixed to the carrier garment to securely hold the armor plate to the carrier garment.

5. The body armor carrier system of claim 4 wherein the carrier garment includes a front panel configured to overlie the torso of the wearer, the section of corresponding hook and loop fastener material is mounted to the outward facing side of the front panel such that the armor plate covers the wearer's torso when the armor plate is affixed to the carrier garment.

6. The body armor carrier system of claim 5 and second armor plate also having a flat ballistic plate member and an outer covering of hook and loop fastener material integrally bonded to and enveloping the ballistic plate member.

7. The body armor carrier system of claim 6 wherein the carrier garment includes a first strap part adapted to wrap around the torso of the wearer, the section of corresponding hook and loop fastener material is mounted to the first strap part such that the second armor plate covers the sides of the wearer's torso when the second armor plate is affixed to the carrier garment.

8. The body armor carrier system of claim 7 and a second elongated strap adapted to extend over the second armor plate and connect to the first strap part when the second armor plate is affixed to the carrier garment to securely hold the armor plate to the carrier garment.

9. A body armor carrier system comprising:

an armor plate having a flat ballistic plate member and an outer covering of hook and loop fastener material integrally bonded to and enveloping the ballistic plate member; and a carrier apparatus adapted to be donned by a wearer for supporting the armor plate therefrom, the carrier apparatus includes a pair of shoulder straps each having a first connection end of corresponding hook and loop fastener material adapted to detachably receive the outer covering of hook and loop fastener material on one side of the armor plate and a second connection end of corresponding hook and loop fastener material adapted to detachably received the outer covering of hook and loop fastener material on the opposite side of the armor plate so that the armor plate is securely affixed to the carrier apparatus.

10. The body armor carrier system of claim 9 wherein the first connection end lies against the one side of the armor plate and the second connection part is integrally connected to the first connection part so that the second connection part wraps over an edge of the armor plate and overlies the opposite side of the armor plate when the armor plate is supported by the carrier apparatus.

11. The body armor carrier system of claim 9 wherein the carrier apparatus includes a first strap part adapted to wrap around the torso of the wearer, the section of corresponding hook and loop fastener material is mounted to the first strap part such that the second armor plate covers the sides of the wearer's torso when the second armor plate is supporte to the carrier apparatus.

12. The body armor carrier system of claim 11 and a second elongate strap adapted to extend over the second armor plate and connect to the first strap part when the second armor plate is affixed to the carrier apparatus to securely hold the armor plate to the carrier apparatus.

13. A body armor carrier system comprising:

an armor plate having a flat ballistic plate member and an outer covering of hook and loop fastener material integrally bonded to and enveloping the ballistic plate member; and a carrier apparatus adapted to be donned by a wearer for supporting the armor plate therefrom, the carrier apparatus includes a shoulder harness having a first connection part of corresponding hook and loop fastener material adapted to detachably receive the outer covering of hook and loop fastener material on one side of the armor plate and a second connection part of corresponding hook and loop fastener material adapted to detachably receive the outer covering of hook and loop fastener material on the opposite side of the armor plate so that the armor plate is securely affixed to the carrier apparatus.

14. The body armor carrier system of claim 13 wherein the first connection part lies against the one side of the armor plate and the second connection part is integrally connected to the first connection part so that the second connection part wraps over an edge of the armor plate and lies against the opposite side of the armor plate when the armor plate is supported by the carrier apparatus.

15. The body armor carrier system of claim 14 wherein the second connection part has a first flap configured to extend over a top edge of the armor plate, and a second flap configured to extend over the bottom edge of the armor plate when the armor plate is supported by the carrier apparatus.

16. The body armor carrier system of claim 14 wherein the second connection part has a pair of first flaps configured to extend over opposed corner edges of the armor plate and a second flap configured to extend over the bottom edge of the armor plate when the armor plate is supported by the carrier apparatus.

17. The body armor carrier system of claim 13 wherein the carrier apparatus includes a first strap part adapted to wrap around the torso of the wearer, the section of corresponding hook and loop fastener material is mounted to the first strap part such that the second armor plate covers the sides of the wearer's torso when the second armor plate is supported to the carrier apparatus.

18. The body armor carrier system of claim 17 and a second elongate strap adapted to extend over the second armor plate and connect to the first strap part when the second armor plate is affixed to the carrier apparatus to securely hold the armor plate to the carrier apparatus.

* * * * *